US010932552B2

(12) United States Patent
Zamarron

(10) Patent No.: US 10,932,552 B2
(45) Date of Patent: Mar. 2, 2021

(54) REACTIONARY TOOL HOLDER DEVICE

(71) Applicant: Salvador Zamarron, Austin, TX (US)

(72) Inventor: Salvador Zamarron, Austin, TX (US)

(73) Assignee: Salvador Zamarron, Austin, TX (US)

( * ) Notice: Subject to any disclaimer, the term of this patent is extended or adjusted under 35 U.S.C. 154(b) by 24 days.

(21) Appl. No.: 16/398,835

(22) Filed: Apr. 30, 2019

(65) Prior Publication Data

US 2019/0335884 A1 Nov. 7, 2019

Related U.S. Application Data

(60) Provisional application No. 62/665,351, filed on May 1, 2018.

(51) Int. Cl.
*A45F 5/02* (2006.01)
*A45F 5/14* (2006.01)

(52) U.S. Cl.
CPC ..... *A45F 5/14* (2013.01); *A45F 5/021* (2013.01); *A45F 2200/0575* (2013.01)

(58) Field of Classification Search
CPC .. A45F 5/021; Y10S 224/904; Y10T 24/1391; Y10T 24/44026; Y10T 24/44017
See application file for complete search history.

(56) References Cited

U.S. PATENT DOCUMENTS 4,325,503 A * 4/1982 Swinney ..... A45F 5/02 224/148.4
4,741,074 A * 5/1988 Budano, II ..... A44B 99/00 224/269
5,060,836 A * 10/1991 Bradford ..... A45F 5/00 224/271
5,864,924 A * 2/1999 Rodriguez ..... A45F 5/02 24/3.1
6,032,337 A 3/2000 Rankin, Jr. et al.
6,193,122 B1 2/2001 Buckley
6,499,637 B1 12/2002 Zamarron
(Continued)

OTHER PUBLICATIONS

Leather Tool Pouch Carpenter Electrician Hammer Pliers Pocket Belt Tools Holder, ebay, n.d. [online], [retrieved on Feb. 5, 2018]. Retrieved from the Internet <https://www.ebay.com/itm/Leather-Tool-Pouch-Carpenter-Electrician-Hammer-Pliers-Pocket-Belt-Tools-Holder-/182018450377?_trksid=p2047675.m43663.10137&nordt=true&rt=nc&orig_cvip=true>.
(Continued)

*Primary Examiner* — Brian D Nash

(57) ABSTRACT

Apparatus and associated methods relate to a tool holder having a tool support member rotationally coupled to a outwardly deflecting member, the tool holder configured to transition between a first mode and a second mode, where in the first mode, the tool support member protrudes away from the rest of the tool holder and the outwardly deflecting member extends longitudinally downward, and where in the second mode, the weight of a stowed tool causes the tool support member to rotate in a downward direction while simultaneously rotating/deflecting the outwardly deflecting member away from a downwardly extending back member. In an illustrative example, the tool holder may push a bottom end of a tool away from a user in response to storage of the tool in the tool holder, thus advantageously mitigating or preventing injury or discomfort from the tool banging or brushing up against the user's leg.

22 Claims, 13 Drawing Sheets

(56) References Cited

U.S. PATENT DOCUMENTS

| | | | | |
|---|---|---|---|---|
| 7,077,303 | B2 * | 7/2006 | Zega | A45F 5/00 224/242 |
| 2004/0045992 | A1 * | 3/2004 | Dohn | A45F 5/021 224/673 |
| 2004/0232187 | A1 | 11/2004 | Zega | |
| 2006/0226182 | A1 | 10/2006 | Dittmar | |
| 2011/0108588 | A1 * | 5/2011 | Bar | B65H 49/205 224/162 |
| 2019/0104832 | A1 * | 4/2019 | Eynav | A44B 17/0011 |

OTHER PUBLICATIONS

Leather Hammer Holder Swivel, Victor Forgings, n.d. [online], [retrieved on Feb. 5, 2018]. Retrieved from the Internet <http://www.victortools.com/leather-hammer-holder-swivel.html>.

Hammer Carries, Gfeller Casemakers, n.d. [online], [retrieved on Feb. 5, 2018]. Retrieved from the Internet <http://www.gfeller.us/hammercarriers.html>.

Toughbuilt Black Hammer Loop Tool Belt Pouch Pocket Holder Hook Storage, ebay, n.d. [online], [retrieved on Feb. 5, 2018]. Retrieved from the Internet <https://www.ebay.com/itm/Toughbuilt-Black-Hammer-Loop-Tool-Belt-Pouch-Pocket-Holder-Hook-Storage-/222535961090>.

* cited by examiner

REACTIONARY TOOL HOLDER DEVICE

CROSS-REFERENCE TO RELATED APPLICATIONS

This application claims the benefit of U.S. Provisional Application Ser. No. 62/665,351, titled "Actuating Reactionary Tool Holder Device," filed by Salvador Zamarron, on May 1, 2018.

This application incorporates the entire contents of the foregoing application(s) herein by reference.

TECHNICAL FIELD

Various embodiments relate generally to tool holding devices.

BACKGROUND

A tool is physical item that can be used to achieve a goal. Tools have been used by humans since pre-history. Tools may be various shapes and sizes, may be made of different types of materials, and may achieve various functional goals. Tools that are used in particular fields or activities may have different designations such as "instrument", "utensil", "implement", "machine", "device," or "apparatus". The use of tools has been a driver of human culture and the rise of civilization.

A tool holder is a device that holds, transports, and/or supports tools. A tool holder may, for example, be a toolbox that holds multiple types of tools. A modern toolbox may retain different types of tools that have different functions. For example, a toolbox may store a wrench, a screwdriver, a pair of pliers, a hammer, and/or a multi-use tool (e.g., a Swiss army knife).

SUMMARY

Apparatus and associated methods relate to a tool holder having a tool support member rotationally coupled to a outwardly deflecting member, the tool holder configured to transition between a first mode and a second mode, where in the first mode, the tool support member protrudes away from the rest of the tool holder and the outwardly deflecting member extends longitudinally downward, and where in the second mode, the weight of a stowed tool causes the tool support member to rotate in a downward direction while simultaneously rotating/deflecting the outwardly deflecting member away from a downwardly extending back member. In an illustrative example, the tool holder may push a bottom end of a tool away from a user in response to storage of the tool in the tool holder, thus advantageously mitigating or preventing injury or discomfort from the tool banging or brushing up against the user's leg and/or body.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
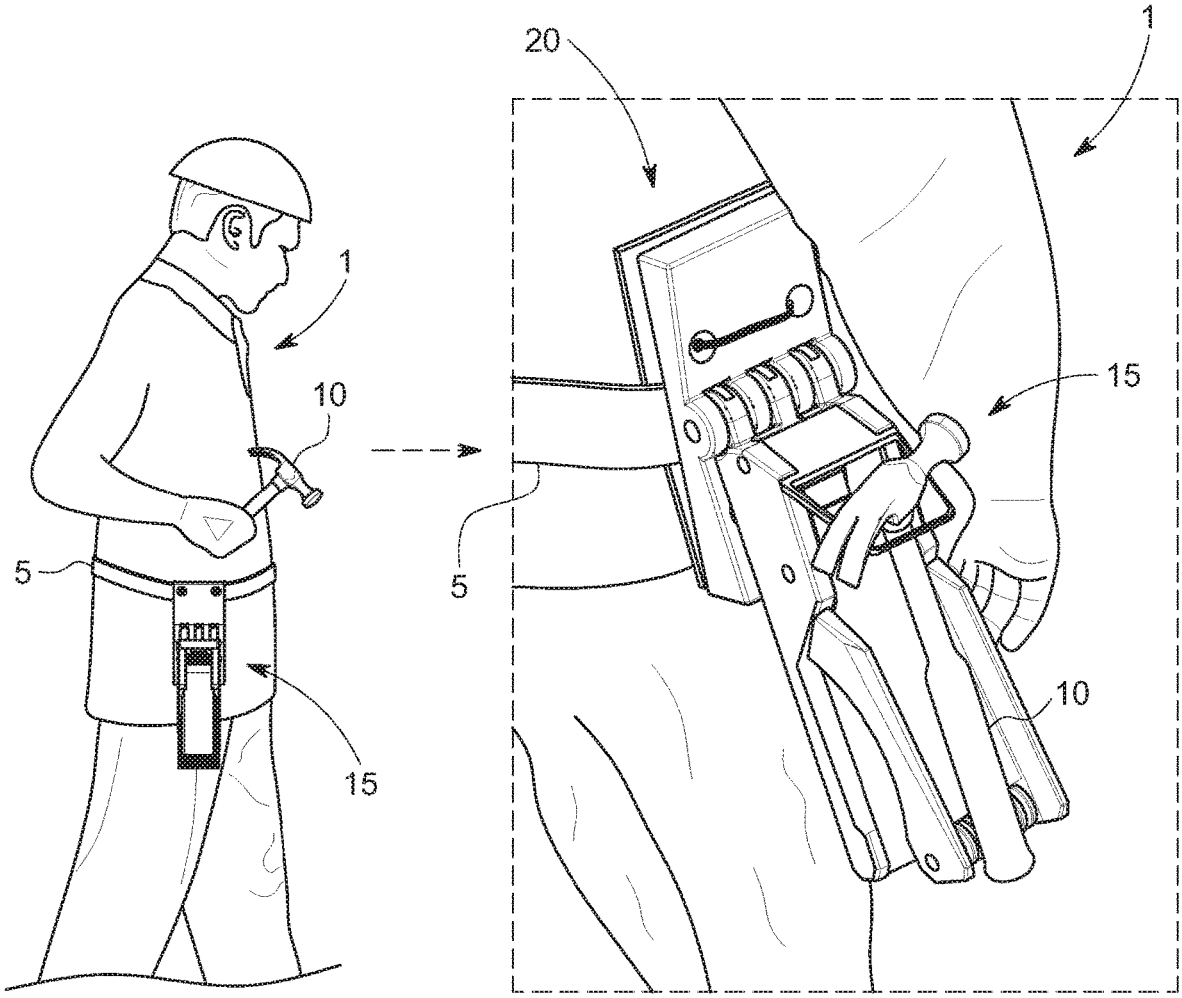
FIG. 1 depicts a perspective view of a user having an exemplary tool holder attached to the user's belt illustrating first and second modes of operation of the tool holder.

FIG. 1 depicts a perspective view of a user having an exemplary tool holder attached to the user's belt illustrating first and second modes of operation of the tool holder. A user 1 is performing construction or repair work at a worksite. The user 1 is wearing a tool belt 5. The user 1 has been working with a tool 10 (e.g., a hammer). After working with the tool 10, the user 1 may desire to store the tool 10 using the user's tool belt 5. However, the user 1 may not want the tool 10 to constantly bang up against their leg while the user 1 walks around the worksite. A tool banging up against a user's leg may be particularly undesirable if the tool includes a jagged or sharp edge/point (e.g., a handheld power drill or power saw), or if the tool is rusty or otherwise dangerous. Such dangerous tools may cause significant harm to the user 1 while the tool is being supported and stored using the tool belt 5. Accordingly, the user 1 may utilize a tool holder 15 that is attached to the tool belt 5 to safely and comfortably store the tool 10 as the user 1 travels around the worksite. The tool holder 15 may advantageously prevent or substantially avoid the tool 10 from brushing or banging up against the user's leg.

A detailed view of the tool holder 15 is shown on the right side of FIG. 1. The tool holder 15 may be substantially similar, in some examples, as tool holder depicted in Appendix C of U.S. Provisional Application Ser. No. 62/665,351, titled "Actuating Reactionary Tool Holder Device," filed by Salvador Zamarron, on May 1, 2018, the entire contents of which is hereby incorporated by reference. The tool holder 15 includes a (belt) attachment member 20. The attachment member 20 may have a rectangular shape, or may be a strap, for example. The attachment member 20 may attach to the user's belt 5 via, for example, a slit in, or a fastener on, the attachment member 20. An exemplary operation of the tool holder 15 is as follows.

A first mode of the tool holder 15 (shown in FIGS. 2C and 3C, for example) may be associated with a tool being absent from the tool holder 15. In this first mode, a tool support member may protrude away from the rest of the tool holder 15 in a direction orthogonal to a longitudinal and lateral axis (e.g., away from the user 1 in a substantially horizontal direction). In this first mode, the outwardly deflecting member may extend longitudinally downward (e.g., down the user's leg in a substantially vertical direction).

Figure 2A:
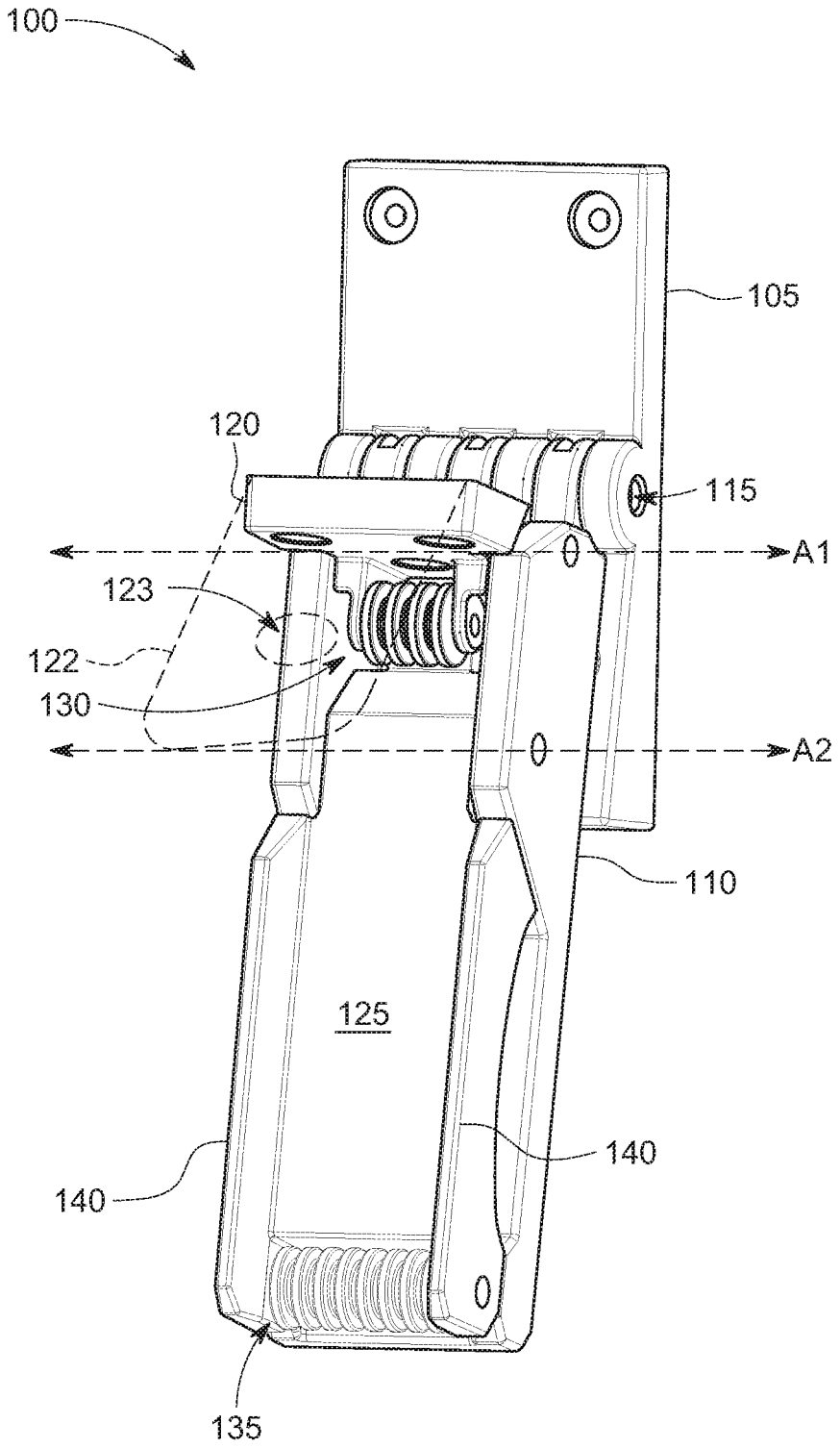
FIG. 2A depicts a perspective view of a first embodiment of an exemplary tool holder in a first mode.
Figure 2B:
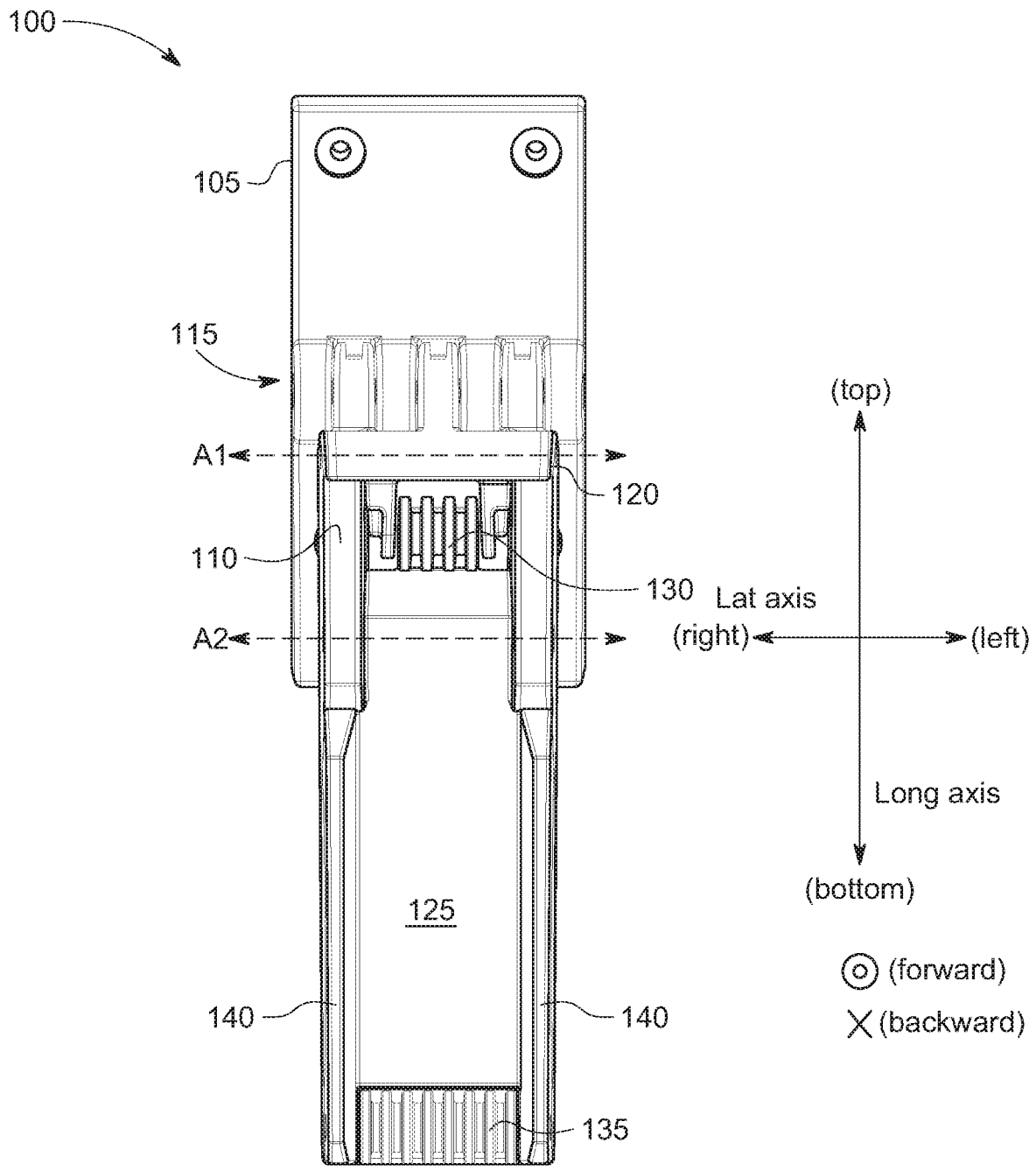
FIG. 2B depicts a front view of a first embodiment of an exemplary tool holder in a first mode.
Figure 2C:
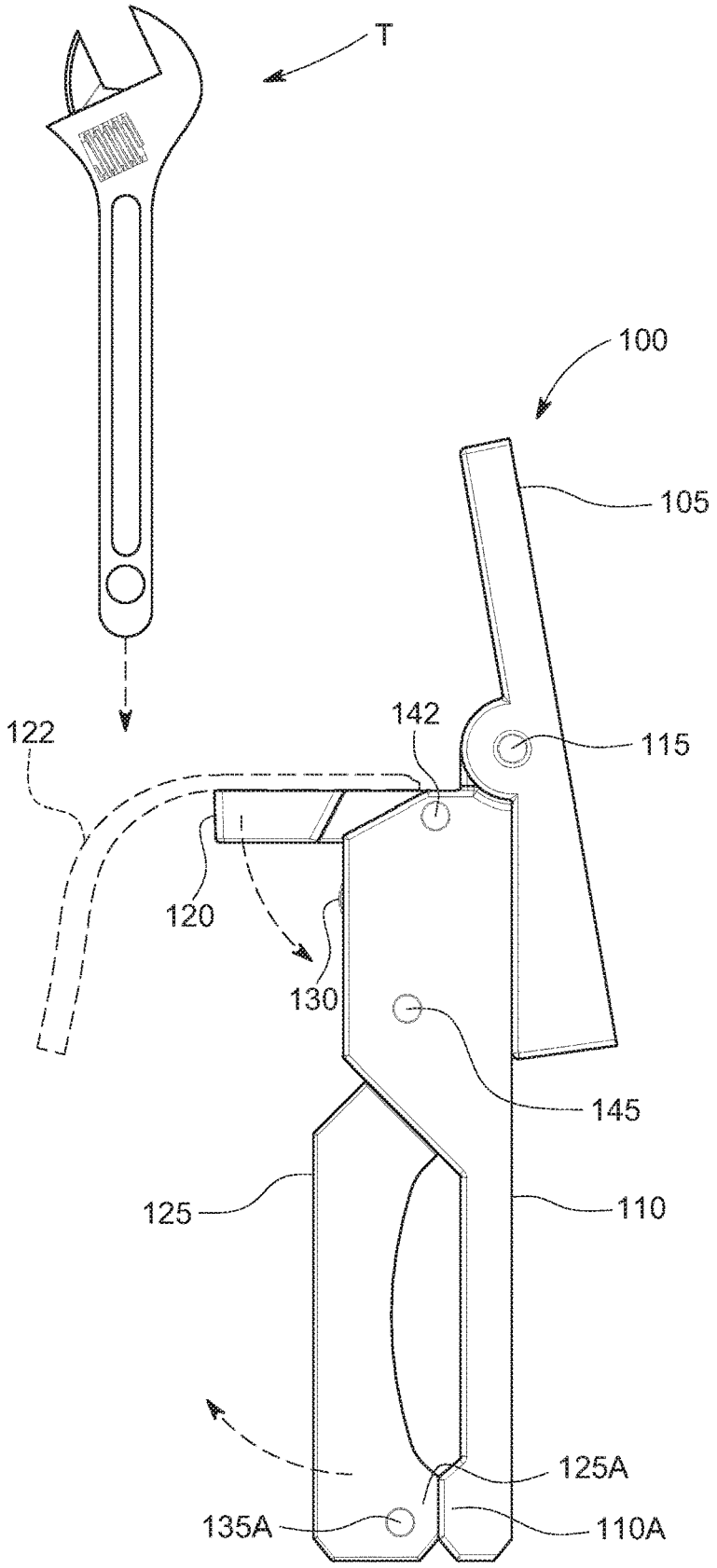
FIG. 2C depicts a side view of a first embodiment of an exemplary tool holder in a first mode.
Figure 2D:
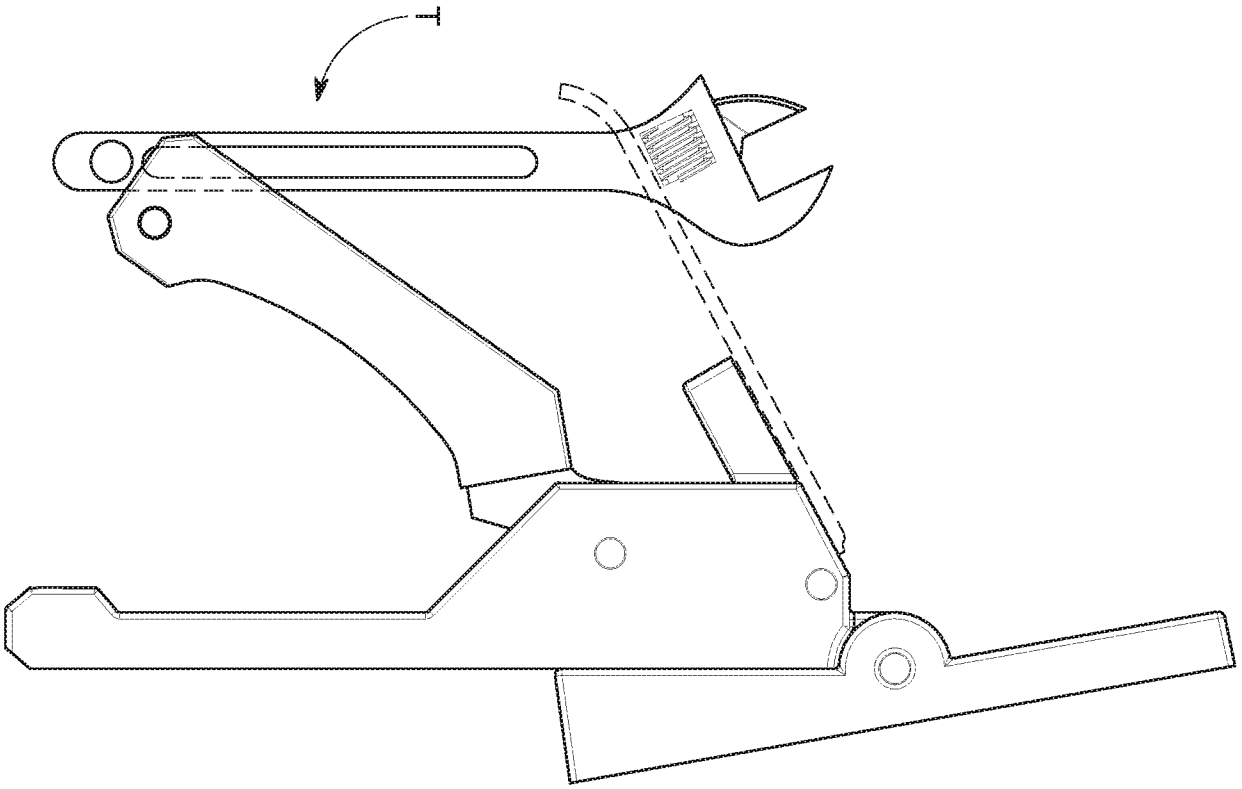
FIG. 2D depicts a side view of a first embodiment of an exemplary tool holder in a second mode.
Figure 3A:
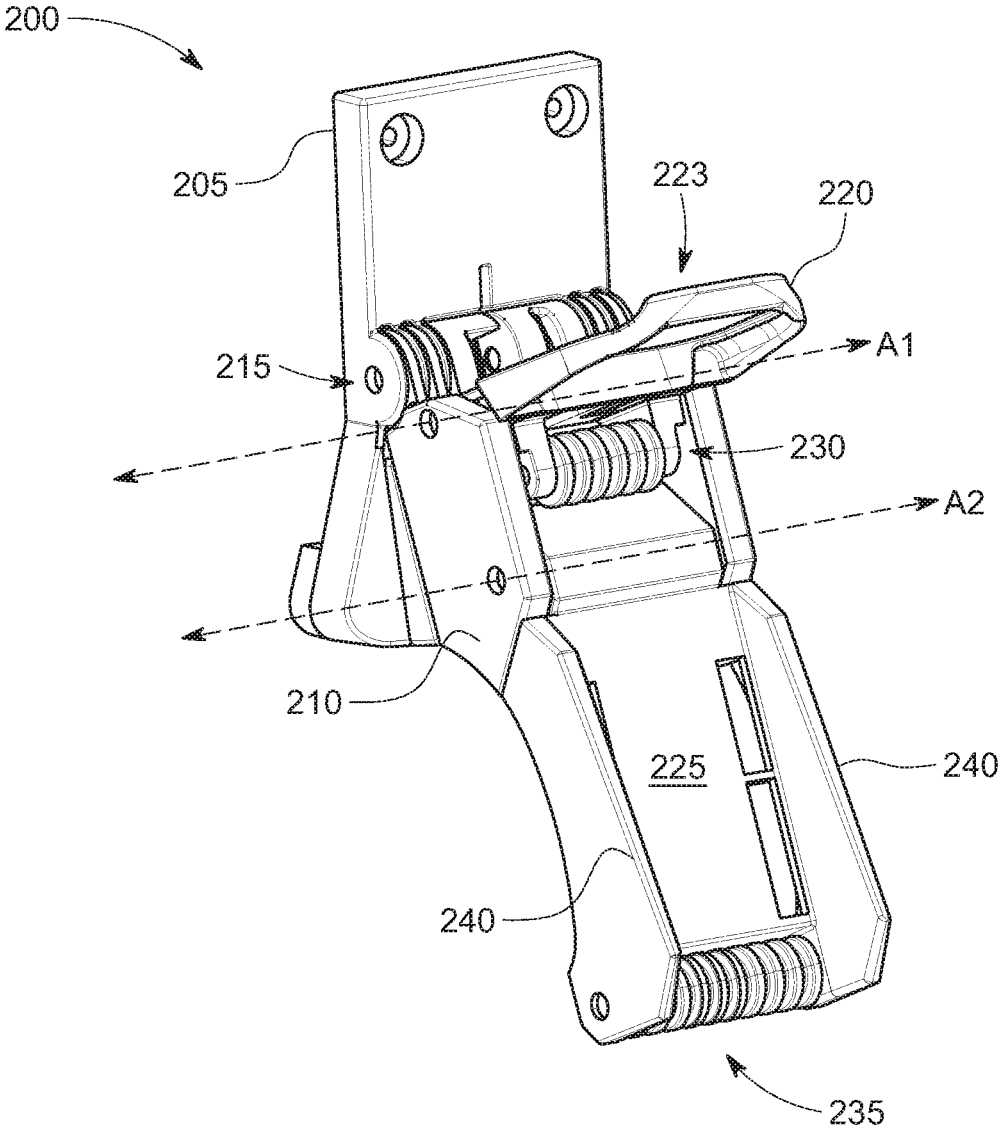
FIG. 3A depicts a perspective view of a second embodiment of an exemplary tool holder in a first mode.
Figure 3B:
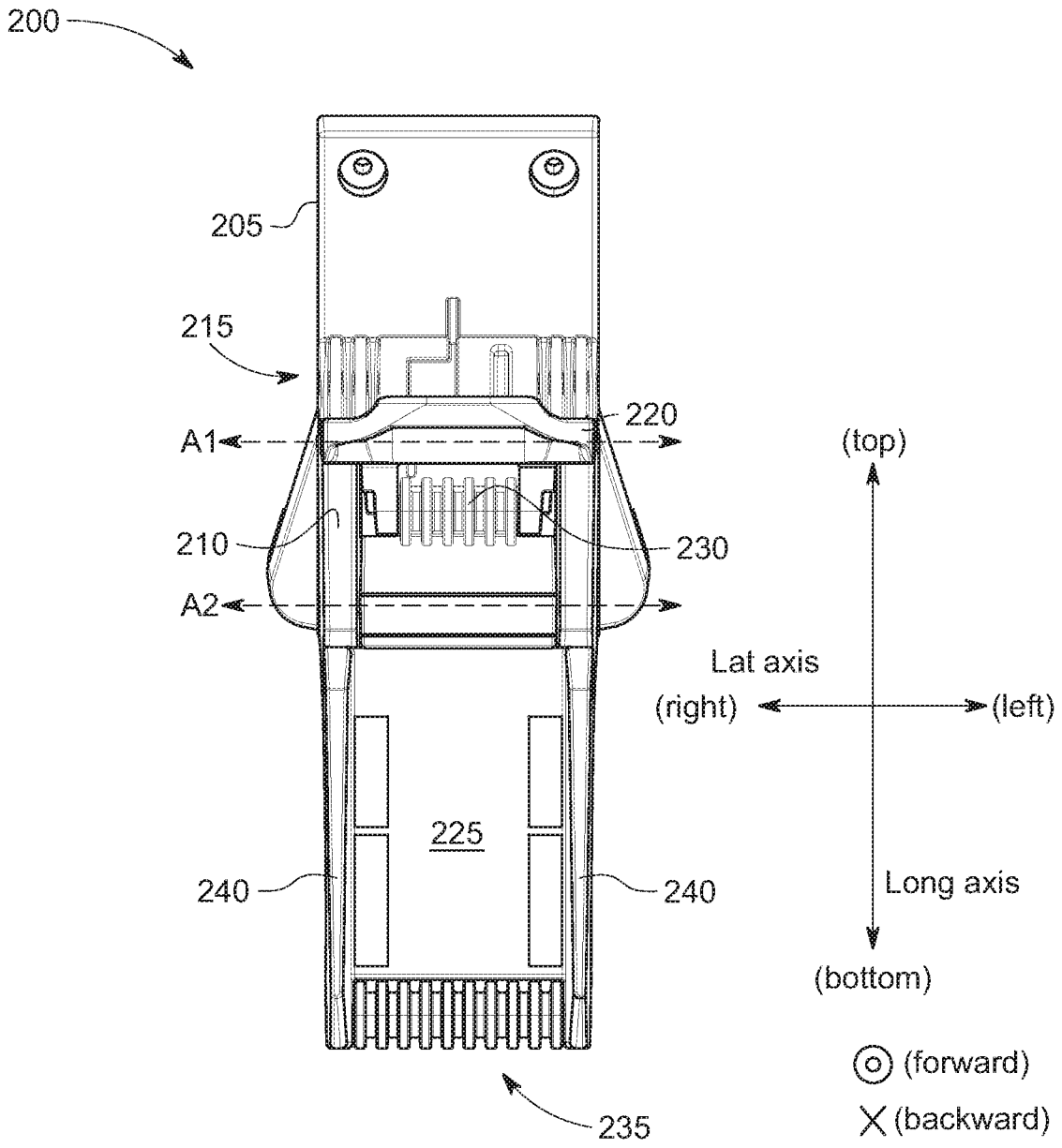
FIG. 3B depicts a front view of a second embodiment of an exemplary tool holder in a first mode.
Figure 3C:
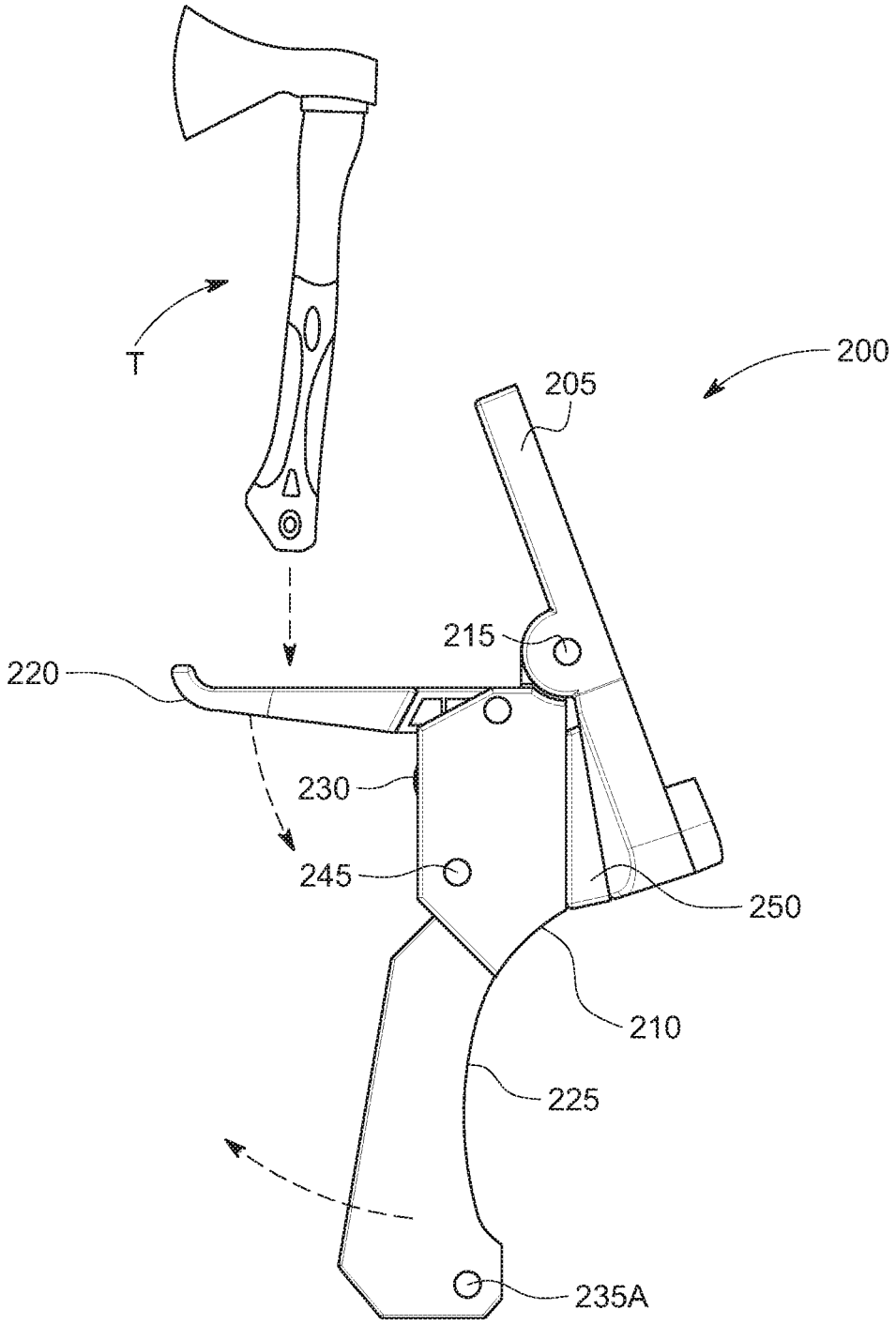
FIG. 3C depicts a side view of a second embodiment of an exemplary tool holder in a first mode.
Figure 3D:
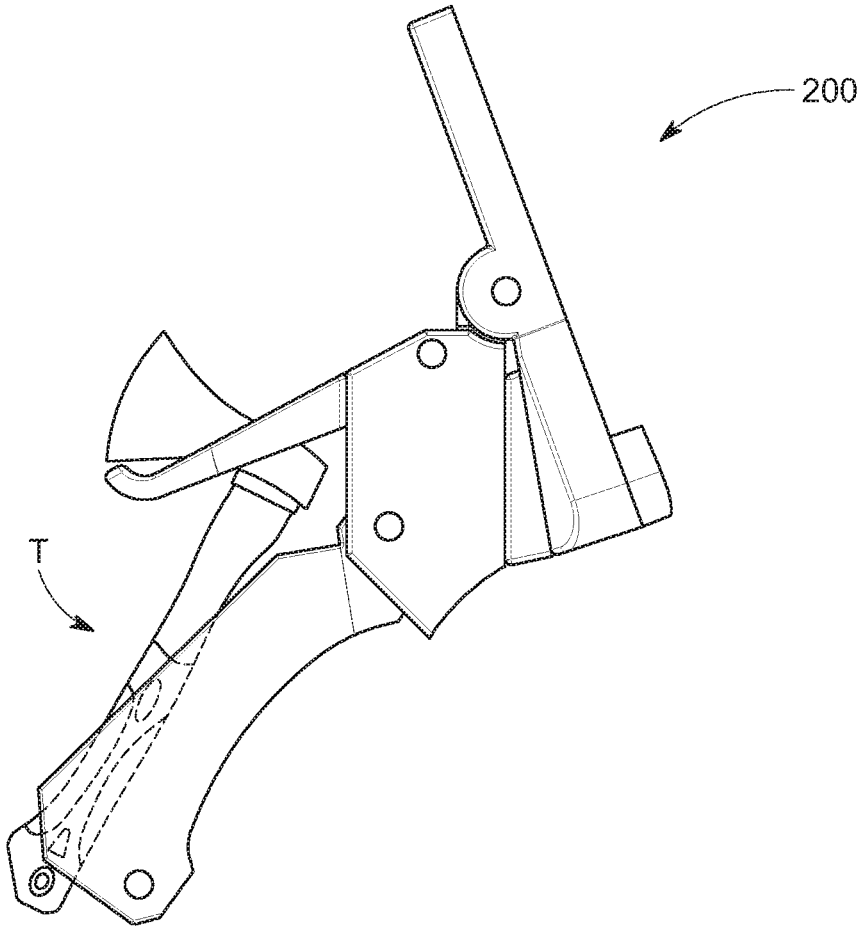
FIG. 3D depicts a side view of a second embodiment of an exemplary tool holder in a second mode.

The user 1 may then couple the tool 10 to the tool support member to transition the tool holder from a first mode to a second mode (shown in FIGS. 2D and 3D, for example). In the depicted embodiment shown in FIG. 1, the tool 10 is a hammer with a bottom end and a top end. The bottom end of the tool 10 may be inserted vertically into an aperture of the tool support member. The top end of the tool 10 may sit on top of and be supported by the upper surface of the tool support member. The first mode of the tool holder 15 transitions to a second mode in response to the weight of the tool 10 forcing downward rotation of the tool support member. For example, the user 1 may insert the tool 10 (bottom end first) through an aperture in the tool support member. In response, the weight of the tool 10 causes the tool support member to rotate in a downward direction. In response to the downward rotation of the tool support member, the outwardly deflecting member rotates/deflects outwardly away from the downwardly extending back member. In this sense, the tool support member and the outwardly deflecting member are "rotatably coupled" to one another.

In this sense, when the weight of the tool 10 is being supported (at a top end) by the tool support member, the bottom end of the tool 10 will be pushed away from the downwardly extending back member by virtue of the outwardly deflecting member rotating about an axis. Accordingly, the tool holder 15 may push a bottom end of a tool 10 away from the user 1 in response to storage of the tool 10 in the tool holder 15, which may advantageously mitigate or prevent injury or discomfort from the tool 10 banging or brushing up against the user's leg. The tool holder 15 may advantageously limit various nuisance and/or dangerous swinging motions of the tool 10 when operatively supported by the tool holder 15.

In some embodiments, the various parts of the tool holder may be formed of a (hard) plastic or polymeric material that may be created, for example, via an injection molding process. In various embodiments, various parts of the tool holder may be formed of fiberglass reinforced nylon, which may advantageously be low cost, tough, and resilient. At least some of the parts of the tool holder 15 may, for example, be formed out of (cut) wood or a composite material. Various components of the tool holder may, in some examples, be formed of metal (e.g., steel or aluminum). In one illustrative embodiment, the tool support member may be formed of various hard metals (e.g., steel), while the other components of the tool support member may be formed of hard plastic. Such a construction may advantageously (1) allow for the tool support member to withstand physical contact with a metallic member of the tool 10, while (2) permitting the rest of the tool holder 15 to be manufactured cost effectively.

FIG. 2A depicts a perspective view of a first embodiment of an exemplary tool holder in a first mode. A tool holder 100 includes a user attachment member 105 (e.g., for attaching to a belt of a user). The attachment member 105 is pivotably (e.g., hingedly) coupled to a downwardly extending back member 110 via a hinge coupling point 115. A tool support member 120 is pivotably coupled to the downwardly extending back member 110. Fixedly coupled to, or included with the tool support member 120, is a flexible retaining strap 122. The flexible retaining strap 122 may include an aperture 123. The flexible retaining strap 122 may retain a tool that is slid in through the aperture 123, and may be fixedly coupled with the rest of the tool support member via a fastener, for example. In some examples, the flexible retaining strap 122 may be formed of leather or rubber. The tool support member 120 is configured to rotate/pivot about a first axis A1. The tool support member 120 may be pivotably (e.g., rotationally and/or hingedly) coupled to the downwardly extending back member 110.

The tool holder 100 includes an outwardly deflecting member 125. The outwardly deflecting member 125 is configured to rotate/pivot about a second axis A2. The outwardly deflecting member 125 may be pivotably coupled to the downwardly extending back member 110, in some implementations. The outwardly deflecting member 125 may deflect away from a user, which may mitigate or prevent a tool from banging or brushing up against the user's leg. In this sense, the outwardly deflecting member 125 may advantageously mitigate or prevent the tool from discomforting or injuring the user while the user travels around with the tool stored in the tool holder 100.

The tool support member 120 is configured to impart a torque force to the outwardly deflecting member 125 by virtue of a torque imparting member 130 (which may be a roller rotatably coupled to the tool support member 120, for example). The outwardly deflecting member 125 includes opposing side rails 140 that longitudinally extend across respective lateral sides of the outwardly deflecting member 125. The outwardly deflecting member 125 includes a roller 135 located on a lower end of the outwardly deflecting member 125. The roller 135 is rotatably coupled to the outwardly deflecting member 125 and rotates on a roller lateral axis. The opposing side rails 140 may advantageously aid in limiting the lateral swinging movement of a tool while it is stored in the tool holder 100. The roller 135 may advantageously aid in minimizing the wear caused by a tool on the lower end of the outwardly deflecting member 125. In various examples, the tool holder 100 may be substantially symmetric about a vertical axis passing through the center of the tool holder 100. For example, the right lateral side of the tool holder 100 may be a substantial mirror image of the left lateral side of the tool holder 100.

FIG. 2B depicts a front view of a first embodiment of an exemplary tool holder in a first mode. In this first mode, the tool support member 120 extends in a substantially horizontal direction away from the rest of the tool holder 100, while the outwardly deflecting member 125 extends in a substantially vertical direction along the tool holder 100. The tool support member 120 extending horizontally and the outwardly deflecting member 125 extending vertically may advantageously allow for a user to conveniently insert a tool vertically into an aperture 123 in the tool support member 120. In some examples, the tool support member 120 in the first mode may make an angle with respect to a longitudinal (vertical) axis of about 45°, 50°, 60°, 70°, 80°, 85°, 90°, 95°, 100°, 110°, 120°, 130°, or about 135°. In some examples, the outwardly deflecting member 125 in the first mode may make an angle with respect to a longitudinal (vertical) axis of about 0°, 5°, 10°, 20°, 30°, 40°, or about 45° or more.

FIG. 2C depicts a side view of a first embodiment of an exemplary tool holder in a first mode. The attachment member 105 is pivotably (e.g., hingedly) coupled to a downwardly extending back member 110 via a pivot/hinge coupling point 115. The tool support member 120 is configured to pivot about the first axis A1 that is aligned with a pivot point 142. The outwardly deflecting member 125 is configured to pivot about the second axis A2 that is aligned with a pivot point 145. The roller 135 is rotatably coupled to the outwardly deflecting member 125 and rotates on a roller lateral pivot axis 135A. In some examples, each pivot points 115, 142, 145, and 135A may include an associated pin that extends laterally across the tool holder 100 to pivotably couple various members to one another.

The downwardly extending back member 110 includes enlarged lower end sections 110A. The outwardly deflecting member 125 includes enlarged lower end sections 125A. The enlarged lower end sections 110A, 125A may physically engage with one another to ensure that the outwardly deflecting member 125 may not rotate past a predetermined angle relative to the downwardly extending back member 110.

In a transition from a first mode to a second mode, the object support member may be rotated counterclockwise about the first lateral axis A1 to cause the torque imparting member 130 to apply a counterclockwise torque to a torque receiving surface (reference 134 in FIG. 2E), to in turn cause the outwardly deflecting member to rotate clockwise about the second lateral axis A2. The torque receiving surface may not be directly connected/attached to the torque imparting member. The torque receiving surface may be arranged to receive the applied torque imparted by the torque imparting member when the torque imparting member physically engages with the torque receiving surface in the second mode (described in detail below).

FIG. 2D depicts a side view of a first embodiment of an exemplary tool holder in a second mode. In this second mode, a force/torque is being applied to the tool supporting member 120 (e.g., due to the gravitational weight of the tool) which causes it to pivot about the first axis A1. In response to the downward pivoting of the tool supporting member 120 about a first axis, the outwardly deflecting member 125 pivots about the second axis A2, by virtue of torque imparting member 130 imparting a torque to a torque receiving surface (shown in FIG. 2E as reference number 134) of the outwardly deflecting member 125. Phrased differently, as the tool supporting member 120 rotates about the first axis A1, it will push the roller 130 in a backward direction (e.g., into the page as shown in FIG. 2B), which pushes the top of the outwardly deflecting member 125 in the backward direction, causing the outwardly deflecting member 125 to pivot about the second axis, resulting in the bottom of the outwardly deflecting member 125 deflecting in a forward direction (e.g., out of the page as shown in FIG. 2B). Accordingly, when a tool is inserted in an aperture 123 of the tool supporting member 120, the weight of the tool will simultaneously pivot the tool supporting member 120 downward while pivoting out the bottom of the outwardly deflecting member 125. In this sense, the tool holder 100 in the second mode may mitigate or prevent various nuisance and/or dangerous swinging of a stored tool near a user's leg.

In the second mode, the tool support member 120 extends/protrudes in a direction away from the rest of the tool holder 100, while the outwardly deflecting member 125 extends in an angled vertical direction relative to the tool holder 100. In some examples, the tool support member 120 in the second mode may make an angle with respect to a longitudinal (vertical) axis of about 95°, 90°, 85°, 80°, 70°, 60°, 50°, 45°, 40°, or about 30°. In some examples, the outwardly deflecting member 125 in the second mode may make an angle with respect to a longitudinal (vertical) axis of about 1°, 5°, 10°, 20°, 30°, 40°, 45°, 50°, 55°, or about 60°.

Figure 2E:
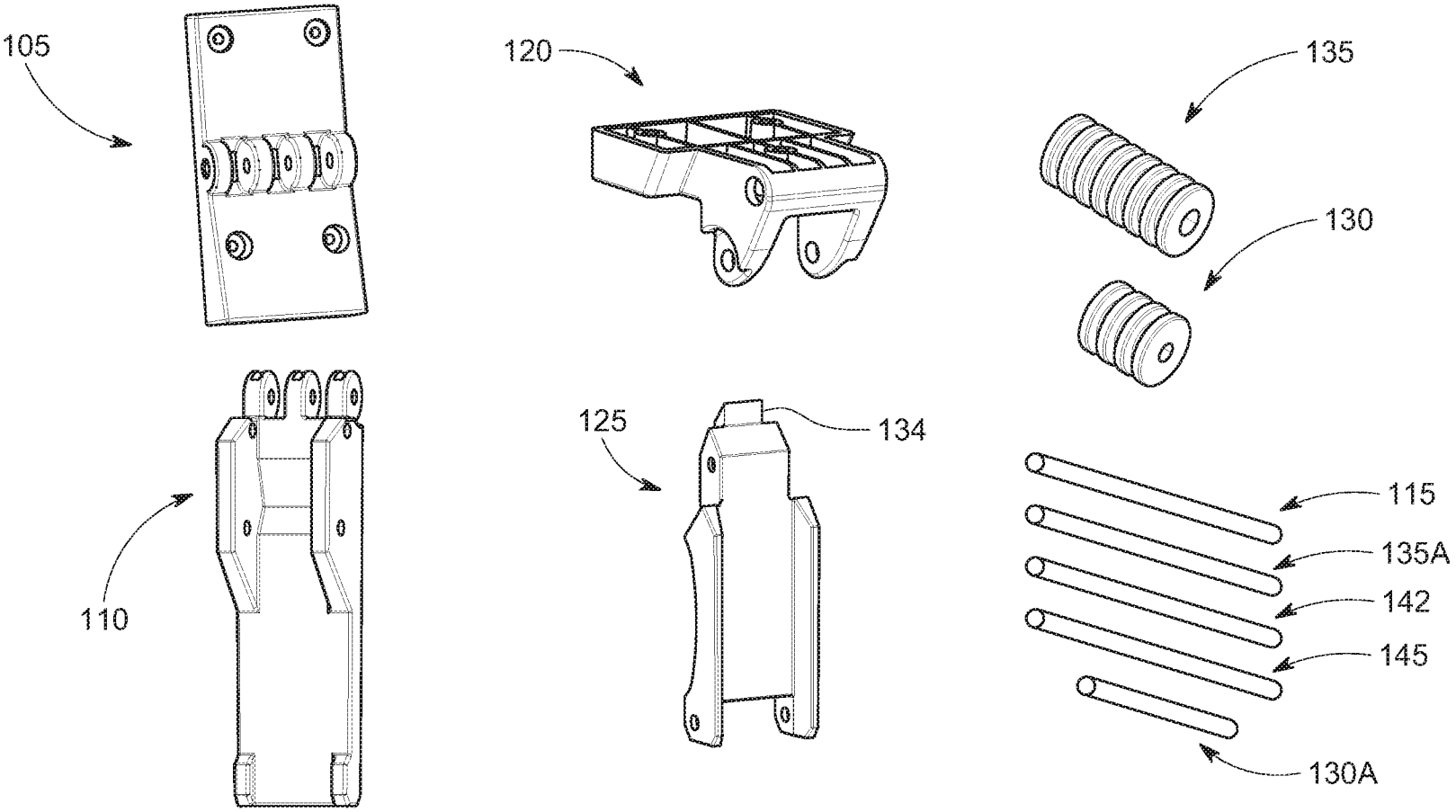
FIG. 2E depicts a perspective view of various disassembled components of a first embodiment of an exemplary tool holder.

FIG. 2E depicts a perspective view of various disassembled components of a first embodiment of an exemplary tool holder. An attachment member 105 is shown above a downwardly extending back member 110. The attachment member 105 and the back member 110 may be pivotably/hingedly coupled with one another (via pivot pin 115) at a center area of the attachment member 105 and a top area of the back member 110. The back member 110 may be pivotably coupled with the tool support member 120 via a pivot pin 142 that is coaxially aligned with the first axis A1 when the tool holder is in an assembled state. The back member may be pivotably coupled with the outwardly deflecting member 125 via a pivot pin 145 that is coaxially aligned with the second axis A2 when tool holder is in an assembled state.

The outwardly deflecting member 125 includes a torque receiving surface 134 configured to receive a torque imparted by a torque imparting member 130. The torque imparting member 130 may be a roller that is rotatably coupled to the tool support member 120 via pivot pin 130A. The outwardly deflecting member 125 may be rotatably coupled with a lower roller 135 via pivot pin 135A.

In various examples, the pivot pins 115, 135A, 142, 145, and 130A may be fixedly coupled to a member. For example, pins 142 and 145 may be fixedly coupled (e.g., welded to) the back member 110. In some embodiments, the pin 130A may be fixedly coupled (e.g., welded to) the tool support member 120. The pin 115 may be fixedly coupled (e.g., welded to) the user attachment member 105, in various implementations. The pin 135A may, for example, be fixedly coupled to the outwardly deflecting member 125.

Figure 2F:
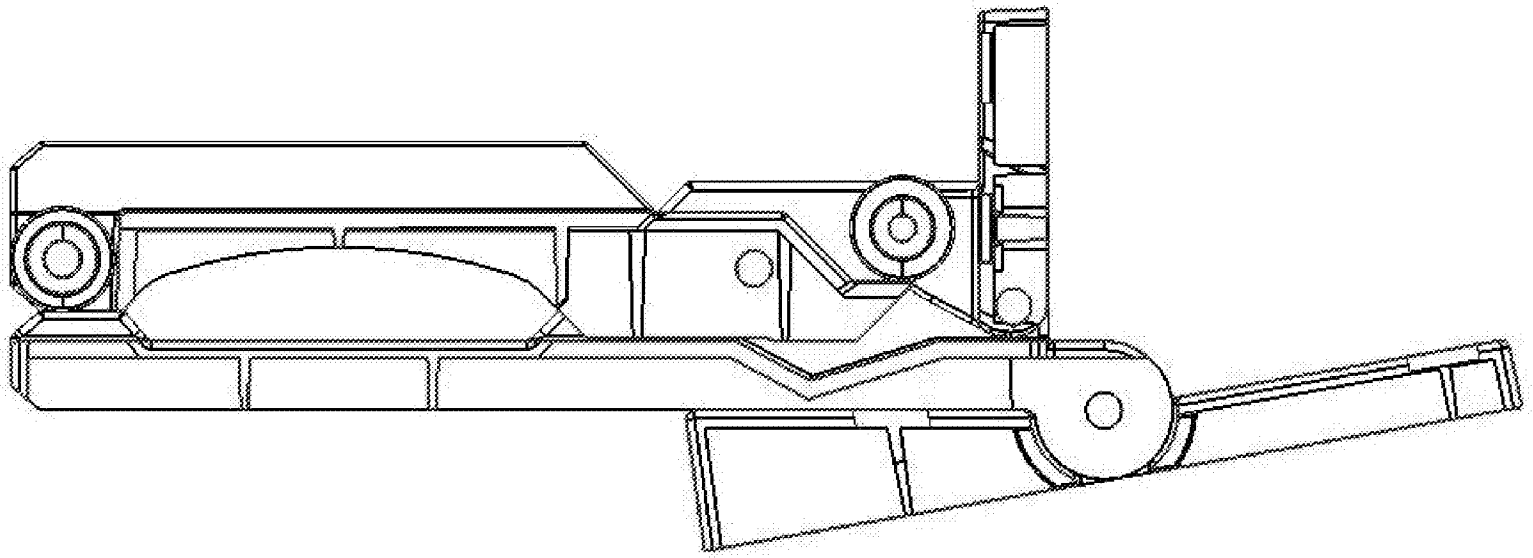
FIG. 2F depicts a side cross sectional view of a first embodiment of an exemplary tool holder in a first mode.

FIG. 2F depicts a side cross sectional view of a first embodiment of an exemplary tool holder in a first mode.

FIG. 3A depicts a perspective view of a second embodiment of an exemplary tool holder in a first mode. A tool holder 200 is shown in a first mode. An attachment member 205 is pivotably (e.g., hingedly) coupled to a downwardly extending back member 210 via a pivot/hinge coupling point 215. In this first mode, a tool support member 220 extends in a substantially horizontal direction away from the rest of the tool holder 200, while an outwardly deflecting member 225 extends in a substantially vertical direction along the tool holder 200. The tool support member 220 is configured to pivot about the first axis A1 that is aligned with a pivot point 242 (see FIG. 3C). The outwardly deflecting member 225 is configured to pivot about the second axis A2 that is aligned with a pivot point 245 (see FIG. 3C). A roller 235 is rotatably coupled to the outwardly deflecting member 225 and rotates on a roller lateral pivot axis 235A. In some examples, each pivot points 215, 242, 245, and 235A may include an associated pin that extends laterally across the tool holder 100 to pivotably couple various members to one another (see FIG. 3E). The outwardly deflecting member 225 includes opposing side rails 240 that longitudinally extend across respective lateral sides of the outwardly deflecting member 225. Coupled (directly) with the tool support member 220 is a torque imparting member 130, which may be a roller that is rotatably coupled to the tool support member 220 via pivot pin 230A, for example (see FIG. 3E). The outwardly deflecting member 225 includes a torque receiving surface 234 configured to receive a torque imparted by a torque imparting member 230 (see FIG. 3E).

FIG. 3B depicts a front view of a second embodiment of an exemplary tool holder in a first mode. The tool holder 200 may be configured to transition from the first mode to an opened-up state, by rotating the tool support member 220 upwards towards the top of the tool holder 200. In various examples, the tool support member 220 may be a rigid and/or highly resilient collar configured to support the weight of a (metallic) tool.

FIG. 3C depicts a side view of a second embodiment of an exemplary tool holder in a first mode. The attachment member 205 is releasably coupled with a (removable) wedge 250. The attachment member 205 may, for example, includes channels/apertures configured to receive coupling flanges of the wedge 250 (see FIG. 3E). The wedge 250 as depicted may lie between a bottom end of the attachment member 205 and a back surface of the downwardly extending back member 210. The wedge 250 may have the effect of angling out the downwardly extending back member 210, which may advantageously prevent the downwardly extending back member 210 from banging or brushing up against a user's leg.

In a transition from a first mode to a second mode, the tool support member 220 may be rotated counterclockwise about the first lateral axis A1 to cause the torque imparting member 230 to apply a counterclockwise torque to a torque receiving surface (reference 234 in FIG. 3E), to in turn cause the outwardly deflecting member 225 to rotate clockwise about the second lateral axis A2. The torque receiving surface may not be directly connected/attached to the torque imparting member. The torque receiving surface may be arranged to receive the applied torque imparted by the torque imparting member when the torque imparting member physically engages with the torque receiving surface in the second mode (described in detail below).

FIG. 3D depicts a side view of a second embodiment of an exemplary tool holder in a second mode. In this second mode, a force/torque is being applied to the tool supporting member 220 (e.g., due to the gravitational weight of the tool) which causes it to pivot about the first axis A1. In response to the downward pivoting of the tool supporting member 220 about a first axis, the outwardly deflecting member 225 pivots about the second axis A2, by virtue of torque imparting member 230 imparting a torque to a torque receiving surface (shown in FIG. 3D as reference number 234) of the outwardly deflecting member 225. Phrased differently, as the tool supporting member 220 rotates about the first axis A1, it will push the roller 230 in a backward direction (e.g., into the page as shown in FIG. 2B), which pushes the top of the outwardly deflecting member 225 in the backward direction, causing the outwardly deflecting member 225 to pivot about the second axis, resulting in the bottom of the outwardly deflecting member 225 deflecting in a forward direction (e.g., out of the page as shown in FIG. 3B). Accordingly, when a tool is inserted in an aperture 223 of the tool supporting member 220, the weight of the tool will simultaneously pivot the tool supporting member 220 downward while pivoting out the bottom of the outwardly deflecting member 225. In this sense, the tool holder 200 in the second mode may mitigate or prevent various nuisance and/or dangerous swinging of a stored tool near a user's leg.

Figure 3E:
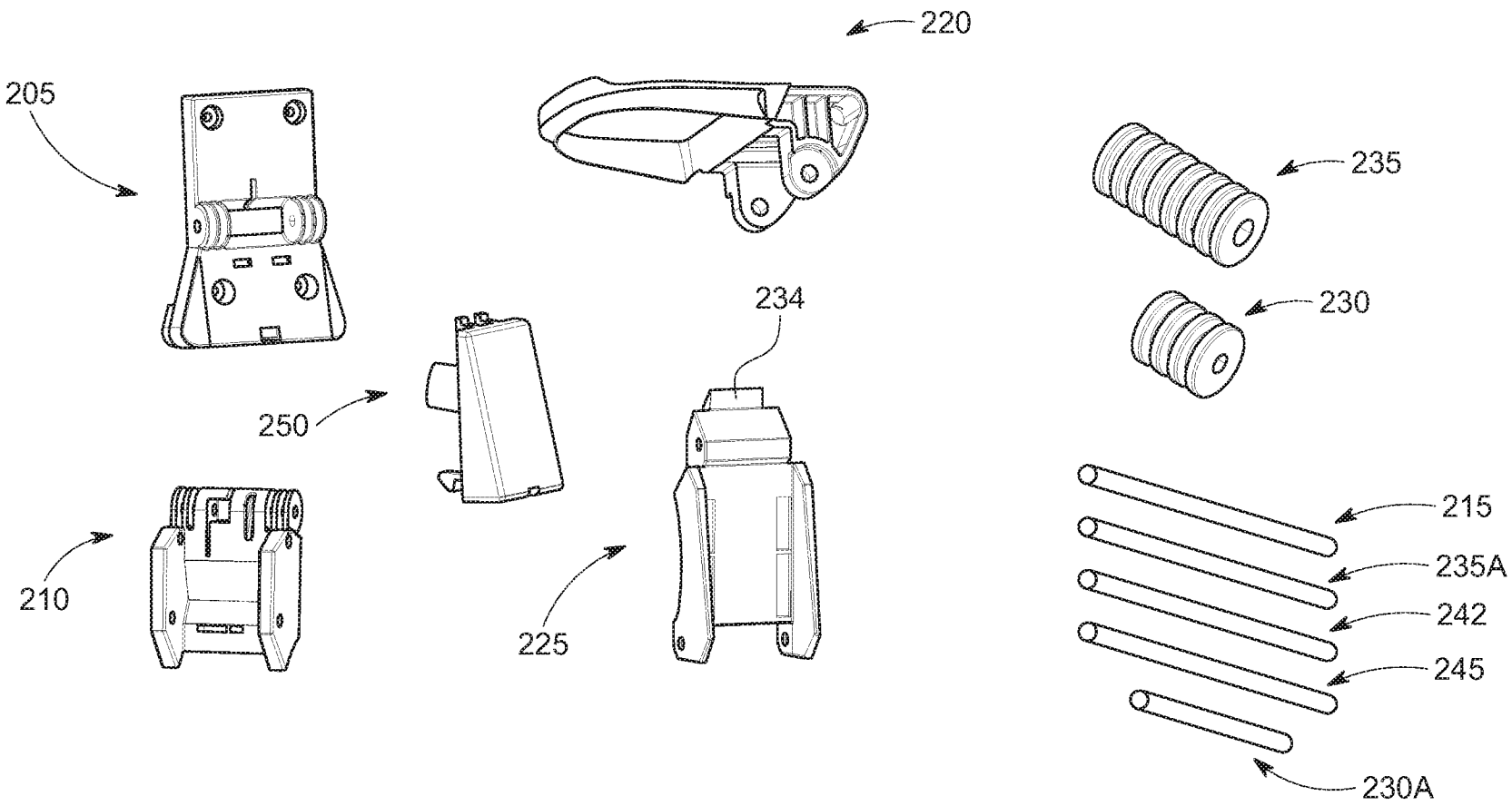
FIG. 3E depicts a perspective view of various disassembled components of a second embodiment of an exemplary tool holder.

FIG. 3E depicts a perspective view of various disassembled components of a second embodiment of an exemplary tool holder. An attachment member 205 is shown above a downwardly extending back member 210. The attachment member 205 and the back member 210 may be pivotably/hingedly coupled with one another (via pivot pin 215) at a center area of the attachment member 205 and a top area of the back member 210. The back member 210 may be pivotably coupled with the tool support member 220 via a pivot pin 242 that is coaxially aligned with the first axis A1 when the tool holder is in an assembled state. The back member 210 may be pivotably coupled with the outwardly deflecting member 225 via a pivot pin 245 that is coaxially aligned with the second axis A2 when tool holder is in an assembled state.

The outwardly deflecting member 225 includes a torque receiving surface 234 configured to receive a torque imparted by a torque imparting member 230. The torque imparting member 230 may be a roller that is rotatably coupled to the tool support member 220 via pivot pin 230A. The outwardly deflecting member 225 may be rotatably coupled with a lower roller 235 via pivot pin 235A.

In various examples, the pivot pins 215, 235A, 242, 245, and 230A may be fixedly coupled to a member. For example, pins 242 and 245 may be fixedly coupled (e.g., welded to) the back member 210. In some embodiments, the pin 230A may be fixedly coupled (e.g., welded to) the tool support member 220. The pin 215 may be fixedly coupled (e.g., welded to) the user attachment member 205, in various implementations. The pin 235A may, for example, be fixedly coupled to the outwardly deflecting member 225.

Figure 3F:
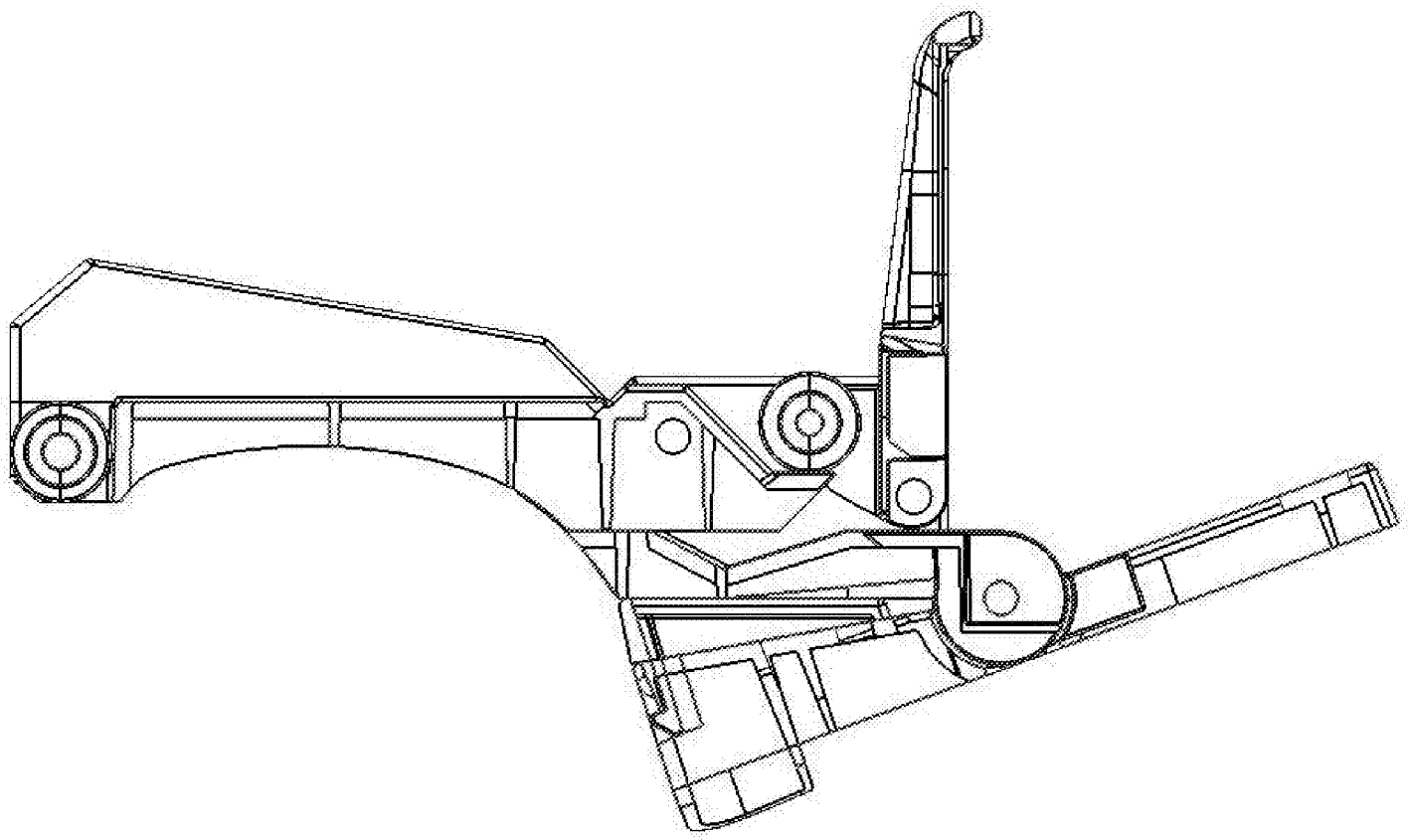
FIG. 3F depicts a side cross sectional view of a second embodiment of an exemplary tool holder in a first mode.

FIG. 3F depicts a side cross sectional view of a second embodiment of an exemplary tool holder in a first mode.

Although various embodiments have been described with reference to the Figures, other embodiments are possible. For example, a tool holder may include a (belt) attachment member. The attachment member may be pivotably (e.g., hingedly) coupled to a downwardly extending back member via a hinge coupling point. A tool support member may be pivotably coupled to the downwardly extending back member. An outwardly deflecting member may be pivotably coupled to the downwardly extending back member. The tool support member may include a pin that rotationally couples a roller to the tool support member. The outwardly deflecting member may include an engagement feature/surface/member configured to make physical contact with the roller. In some examples, the engagement feature may be a protrusion of the outwardly deflecting member. The engagement feature may, in some embodiments, be integrally formed with the outwardly deflecting member.

A a tool holder may be configured to transition to an opened-up state. An opened up state may be depicted, for example, in FIG. 3B of U.S. Provisional Application Ser. No. 62/665,351, titled "Actuating Reactionary Tool Holder Device," filed by Salvador Zamarron, on May 1, 2018, the entire contents of which is hereby incorporated by reference. A tool holder may have the tool support member which is not directly coupled/attached (e.g., free from) the outwardly deflecting member. Absence of a direct coupling may allow for the tool support member to freely pivot upward without being limited by the outwardly deflecting member. Pivoting of the tool support member upward may advantageously provide a slimmer profile tool holder that may provide clearance and be less likely to interfere with objects around a user's legs when the tool holder is in an opened-up state.

When the tool holder transitions to a second mode, a force/torque may be applied to the tool supporting member, which causes it to pivot about a first axis. In response to the downward pivoting of the tool supporting member about a first axis, the outwardly deflecting member may pivot about a second axis, by virtue of a roller imparting a backward directed force/torque on the engagement feature/surface/member. As the tool supporting member transitions from the opened-up state to the first mode, the roller and engagement feature may begin to approach one another. In the first mode, the roller and the engagement feature may make physical contact with one another. Once sufficient downward force is applied to the tool supporting member, the tool supporting member pivots downward, causing a torque imparting member of the tool support member (e.g., a roller) to translate backward. The roller translating backward may cause a backward force on the engagement feature, which may push the top of the outwardly deflecting member in the backward direction. When the top of the outwardly deflecting member is pushed in the backward direction, it may cause the outwardly deflecting member to pivot about the second axis, resulting in the bottom of the outwardly deflecting member deflecting in a forward direction. Accordingly, when a tool is inserted in an aperture of the tool supporting member, the weight of the tool may simultaneously pivot the tool supporting member downward while pivoting out the bottom of the outwardly deflecting member. In this sense, the tool holder in the second mode may mitigate or prevent nuisance and/or dangerous swinging of a stored tool near a user's leg.

In some examples, the roller of the tool supporting member may be an optional feature. For example, the tool supporting member may have its own associated engagement feature (e.g., a protrusion without a roller, or just a pin) configured to engage with the engagement feature of the outwardly deflecting member.

Various embodiments of a tool holder may include a spring configured to bias the outwardly deflecting member towards physical engagement with the downwardly extending back member. Exemplary springs are disclosed, for example, in FIG. 5A of U.S. Provisional Application Ser. No. 62/665,351, titled "Actuating Reactionary Tool Holder Device," filed by Salvador Zamarron, on May 1, 2018, the entire contents of which is hereby incorporated by reference. The spring may advantageously prevent the outwardly deflecting member from swinging outward when a tool is not stored in the tool holder. In some examples, the spring may be a hinge spring or a coil spring. In various examples, the spring may be a linear or non-linear (e.g., progressive) spring. In some embodiments, the spring may be a resilient elastic band (e.g., similar to a rubber band). In various examples, the outwardly deflecting member may be springingly coupled to the downwardly extending back member, such that the outwardly deflecting member may be under spring bias with respect to the downwardly extending back member. The spring may provide a biasing force when stretched or compressed from its equilibrium position.

Some exemplary tool holder embodiments employ cam surfaces to rotationally couple the tool support member with the outwardly deflecting member. Exemplary cam surfaces are disclosed, for example, in FIGS. 10A and 10B of U.S. Provisional Application Ser. No. 62/665,351, titled "Actuating Reactionary Tool Holder Device," filed by Salvador Zamarron, on May 1, 2018, the entire contents of which is hereby incorporated by reference. The tool support member may include a first engagement/cam surface configured to physically and forcefully/torquingly engage with a second engagement/cam surface of the outwardly deflecting member. In this sense, as the tool support member pivots about a first axis, the first engagement/cam surface may move in a backward direction, forcing the second engagement/cam surface back, which causes the outwardly deflecting member to pivot about a second axis.

In some embodiments, complementary gears may be used to rotationally couple an object/tool support member with an outwardly deflecting member. For example, a torque imparting member of an object support member may be a first gear, while a torque receiving surface of an outwardly deflecting member may be a second gear. Exemplary first and second gears are disclosed, for example, in FIGS. 8A and 8B of U.S. Provisional Application Ser. No. 62/665,351, titled "Actuating Reactionary Tool Holder Device," filed by Salvador Zamarron, on May 1, 2018, the entire contents of which is hereby incorporated by reference. In this exemplary embodiment, the tool support portion includes a first gear, while the outwardly deflecting portion includes a second gear. The first and second gears intermesh with one another such that rotation of one will impart rotation to the other. Accordingly, placing a tool in the tool support portion may cause the first gear to rotate in a first direction, which in turn may cause the second gear to rotate in a second direction opposite from the first direction, resulting in the bottom end of the outwardly deflecting portion to be rotated outward and upward.

Various objects or tools may be stowed using a tool holder. For example, a tool holder may be used to store a pipe, a wrench, a power drill, a hand saw, a crowbar, a square tool, a chisel, or pruning shears. These tools are merely exemplary and are not limited to a specific type of tool. In various embodiments, the tool holder may hold various objects that may not be tools (e.g., per say). For example, the tool holder may be used to store/retain a water bottle, climbing gear, a cell phone, a pricing gun, a radio, a billy-club, various musical instruments, binoculars, weapons, a safety retraction lanyard, various medical devices, and/or a camera. In this sense, a tool holder may be referred to as an "object holder."

Different embodiments may have different types of attachment/coupling mechanisms for holding different types of tools/objects. For example, a curved collar may be used to store a hammer, a slit may be used to store a square tool, a circular or oval-shaped aperture may be used to store a crowbar. In some examples, a tool holder may have multiple attachment/coupling mechanisms to simultaneously hold multiple tools. For example, a tool holder may include a slot for a square tool, and a rounded hole for a chisel. In various embodiments, a center of gravity/mass of a tool may lie below the tool support member. In some examples, a tool support member is rotationally coupled to the outwardly deflecting member, such that when the tool support member pivots downward about a first (pivot) axis, the bottom end outwardly deflecting member is caused to rotate outward about a second (pivot) axis.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A reactionary tool holder comprising:

a base member (110, 210);

an object support member (120, 220) rotatably coupled with the base member to rotate about a first lateral axis (A1), the object support member comprising a torque imparting member (130, 230);

an outwardly deflecting member (125, 225) rotatably coupled with the base member to rotate about a second lateral axis (A2) parallel to the first lateral axis, the outwardly deflecting member comprising a torque receiving surface (134);

a first laterally extending member (142, 242) that rotatably couples the base member to the object support member; and, a second laterally extending member (145, 245) that rotatably couples the base member to the outwardly deflecting member, wherein:

in a transition from a first mode to a second mode, the object support member is rotated in a first rotational direction about the first lateral axis to cause the torque imparting member to apply a torque in the first rotational direction to the torque receiving surface to cause the outwardly deflecting member to rotate in a second, opposite rotational direction about the second lateral axis, the torque receiving surface is (1) not directly connected to the torque imparting member, and (2) arranged to receive the applied torque imparted by the torque imparting member when the torque imparting member physically engages with the torque receiving surface in the second mode, and, the torque imparting member comprises a roller rotatably coupled to the object support member.

2. The reactionary tool holder of claim 1, wherein the first and second lateral axes are spatially offset from one another.

3. The reactionary tool holder of claim 1, wherein the torque imparting member is not integrally formed with the torque receiving surface, such that the torque imparting member is freely movable relative to the torque receiving surface in an open state.

4. The reactionary tool holder of claim 1, wherein in the transition from the first mode to the second mode, the object support member is caused to rotate counterclockwise by a gravity force vector associated with an object being supported by the object support member.

5. The reactionary tool holder of claim 1, wherein in the first mode, the base member extends along a first longitudinal axis, the outwardly deflecting member extends along a second longitudinal axis parallel to the first longitudinal axis, and the object support member extends along a forward axis substantially orthogonal to the first longitudinal axis.

6. The reactionary tool holder of claim 1, wherein the outwardly deflecting member comprises a pair of laterally opposed side rails (140, 240) extending along a length of the outwardly deflecting member.

7. The reactionary tool holder of claim 1, wherein the object support member comprises a flexible member (122) having a hole (123), the flexible member configured to support the weight of an object when the object is inserted into the hole.

8. The reactionary tool holder of claim 1, wherein the object support member comprises a rigid member (223) having a hole (223), the rigid member configured to support the weight of an object when the object is inserted into the hole.

9. The reactionary tool holder of claim 1, wherein the outwardly deflecting member is spring biased against the base member in the first mode.

10. A reactionary tool holder comprising:

a base member (110, 210);

an object support member (120, 220) rotatably coupled with the base member to rotate about a first lateral axis (A1), the object support member comprising a torque imparting member (130, 230);

an outwardly deflecting member (125, 225) rotatably coupled with the base member to rotate about a second lateral axis (A2) parallel to the first lateral axis, the outwardly deflecting member comprising a torque receiving surface (134);

a first laterally extending member (142, 242) that rotatably couples the base member to the object support member; and, a second laterally extending member (145, 245) that rotatably couples the base member to the outwardly deflecting member, wherein:

in a transition from a first mode to a second mode, the object support member is rotated in a first rotational direction about the first lateral axis to cause the torque imparting member to apply a torque in the first rotational direction to the torque receiving surface to cause the outwardly deflecting member to rotate in a second, opposite rotational direction about the second lateral axis, and, the torque receiving surface is (1) not directly connected to the torque imparting member, and (2) arranged to receive the applied torque imparted by the torque imparting member when the torque imparting member physically engages with the torque receiving surface in the second mode.

11. The reactionary tool holder of claim 10, wherein the first and second lateral axes are spatially offset from one another.

12. The reactionary tool holder of claim 10, wherein the torque imparting member is not integrally formed with the torque receiving surface, such that the torque imparting member is freely movable relative to the torque receiving surface in an open state.

13. The reactionary tool holder of claim 1, wherein the outwardly deflecting member comprises a pair of laterally opposed side rails (140, 240) extending along a length of the outwardly deflecting member.

14. The reactionary tool holder of claim 1, wherein the object support member comprises a flexible member (122) having a hole (123), the flexible member configured to support the weight of an object when the object is inserted into the hole.

15. The reactionary tool holder of claim 1, wherein the object support member comprises a rigid member (223) having a hole (223), the rigid member configured to support the weight of an object when the object is inserted into the hole.

16. The reactionary tool holder of claim 10, wherein the outwardly deflecting member is spring biased against the base member in the first mode.

17. The reactionary tool holder of claim 10, wherein the torque imparting member comprises a first gear, and the torque receiving surface is comprised in a second gear, wherein the first gear and the second gear are intermeshed with one another.

18. A reactionary tool holder comprising:

a base member (110, 210);

an object support member (120, 220) rotatably coupled with the base member to rotate about a first lateral axis (A1), the object support member comprising a torque imparting member (130, 230);

an outwardly deflecting member (125, 225) rotatably coupled with the base member to rotate about a second lateral axis (A2) parallel to the first lateral axis, the outwardly deflecting member comprising a torque receiving surface (134); and, a user coupling member (105) rotatably coupled to the base member, the user coupling member comprising a user attachment mechanism (20) configured to attach the user coupling member to a user's belt, wherein:

in a transition from a first mode to a second mode, the object support member is rotated in a first rotational direction about the first lateral axis to cause the torque imparting member to apply a torque in the first rotational direction to the torque receiving surface to cause the outwardly deflecting member to rotate in a second, opposite rotational direction about the second lateral axis, the torque receiving surface is (1) not directly connected to the torque imparting member, and (2) arranged to receive the applied torque imparted by the torque imparting member when the torque imparting member physically engages with the torque receiving surface in the second mode, and wherein the user coupling member comprises a wedge-shaped cross section having a wedge surface configured to physically engage with a back surface of the base member.

19. The reactionary tool holder of claim 18, wherein the outwardly deflecting member comprises a pair of laterally opposed side rails (140, 240) extending along a length of the outwardly deflecting member, and the torque imparting member comprises a roller rotatably coupled to the object support member.

20. The reactionary tool holder of claim 18, wherein the user coupling member further comprises a wedge (250) releasably coupled to the user coupling member and disposed between the user coupling member and the base member.

21. The reactionary tool holder of claim 18, wherein the outwardly deflecting member is spring biased against the base member in the first mode.

22. The reactionary tool holder of claim 18, wherein the torque imparting member comprises a first gear, and the torque receiving surface is comprised in a second gear, wherein the first gear and the second gear are intermeshed with one another.

* * * * *